US008702333B2

(12) United States Patent
Geuther

(10) Patent No.: US 8,702,333 B2
(45) Date of Patent: Apr. 22, 2014

(54) QUICK-FASTENING APPLICATOR CLOSURE

(75) Inventor: Manuela Geuther, Ansbach (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 13/462,672

(22) Filed: May 2, 2012

(65) Prior Publication Data

US 2012/0282009 A1 Nov. 8, 2012

(30) Foreign Application Priority Data

May 3, 2011 (DE) ..... 20 2011 100 181 U

(51) Int. Cl.
*A46B 11/00* (2006.01)

(52) U.S. Cl.
USPC ..... 401/129; 401/126; 512/321

(58) Field of Classification Search
USPC ..... 401/126, 129; 215/321, 330, 331, 335, 215/329, 346, 44, 43, 336; 220/300, 293, 220/288
See application file for complete search history.

(56) References Cited

U.S. PATENT DOCUMENTS

| | | | | | |
|---|---|---|---|---|---|
| 728,981 | A * | 5/1903 | Rose | 215/274 |
| 1,341,592 | A * | 5/1920 | Ruehle | 220/300 |
| 1,434,322 | A * | 10/1922 | Wigzell | 220/300 |
| 1,975,498 | A * | 10/1934 | Billerman | 220/377.1 |
| 2,185,897 | A * | 1/1940 | Krause et al. | 210/244 |
| 3,913,783 | A * | 10/1975 | Cooper | 220/300 |
| 4,091,955 | A * | 5/1978 | Sloan, Sr. | 220/288 |
| 4,257,526 | A * | 3/1981 | Weits et al. | 215/332 |
| 4,572,375 | A * | 2/1986 | Baer | 239/56 |
| 4,591,063 | A * | 5/1986 | Geiger | 215/330 |
| 4,640,430 | A * | 2/1987 | Haines | 215/330 |
| 4,723,686 | A * | 2/1988 | Pennisi | 220/300 |
| 5,007,442 | A * | 4/1991 | Hirzel | 132/218 |
| 5,064,082 | A * | 11/1991 | Lombardi et al. | 215/6 |
| 5,184,741 | A * | 2/1993 | Chevassus et al. | 215/331 |
| 5,398,837 | A * | 3/1995 | Degrassi | 220/835 |
| 5,494,174 | A * | 2/1996 | Rohr et al. | 215/330 |
| 5,810,497 | A * | 9/1998 | Bachmann et al. | 401/129 |
| 5,944,208 | A * | 8/1999 | Gale | 215/296 |
| 6,076,689 | A * | 6/2000 | Vassallo | 215/209 |
| 7,494,295 | B2 * | 2/2009 | Delage | 401/130 |
| 7,571,826 | B2 * | 8/2009 | Miceli et al. | 215/228 |

(Continued)

FOREIGN PATENT DOCUMENTS

| | | | |
|---|---|---|---|
| DE | 19525173 | A1 | 1/1997 |
| EP | 2253554 | A1 | 11/2010 |
| GB | 2417232 | A * | 2/2006 |

*Primary Examiner* — David Walczak
*Assistant Examiner* — Bradley Oliver
(74) *Attorney, Agent, or Firm* — Setter Roche LLP

(57) ABSTRACT

The invention relates to a quick-fastening applicator closure comprising a cap-side closure member and a container-side closure member which are twisted relative to one another in order to fix the applicator on the storage container associated with it. A multi-start, preferably double-start, short-threaded portion is provided on at least one of the closure members, whose threads are designed in such a way that the two closure members can be brought from a position in which the threads of the short threaded portion grip for the first time into a fully closed position with a rotary movement less than a ⅜ rotation relative to one another, with additional retaining elements being provided which hold the two closure members firmly against each other in addition to the thread friction that is present anyway, once they have reached their fully closed position.

12 Claims, 7 Drawing Sheets

(56) References Cited

U.S. PATENT DOCUMENTS

| | | | | |
|---|---|---|---|---|
| 7,673,763 | B1 * | 3/2010 | Oh | 215/332 |
| 7,802,692 | B2 * | 9/2010 | Maejima et al. | 220/293 |
| 7,878,351 | B2 * | 2/2011 | Falzoni et al. | 215/252 |
| 8,292,531 | B2 * | 10/2012 | Rauschert et al. | 401/129 |
| 2002/0063104 | A1 * | 5/2002 | Randall et al. | 215/329 |
| 2004/0211781 | A1 * | 10/2004 | Lin | 220/288 |
| 2005/0155970 | A1 * | 7/2005 | Maejima et al. | 220/293 |
| 2006/0051153 | A1 * | 3/2006 | Delage | 401/119 |
| 2006/0086688 | A1 * | 4/2006 | Tang-Lee | 215/44 |
| 2007/0034595 | A1 * | 2/2007 | Foster et al. | 215/330 |
| 2007/0039914 | A1 * | 2/2007 | Buono | 215/222 |
| 2008/0257848 | A1 * | 10/2008 | Farrar et al. | 215/44 |
| 2010/0143021 | A1 * | 6/2010 | De Laforcade | 401/129 |
| 2010/0294813 | A1 | 11/2010 | Delage | |
| 2012/0282008 | A1 * | 11/2012 | Geuther et al. | 401/122 |

* cited by examiner

QUICK-FASTENING APPLICATOR CLOSURE

FIELD OF THE INVENTION

The invention relates to a quick-fastening applicator closure.

BACKGROUND OF THE INVENTION

The attachment of cosmetics applicators on the inside of a cover or a cap which then simultaneously form the handle part of the applicator in many cases is known in the prior art. If the cover with the applicator is placed on the cosmetics container or screwed or latched onto it, the applicator dips into the storage container and is wetted there with the cosmetic.

In the far predominant number of cases, the cover carrying the applicator is equipped with a fine threaded portion. With several turns, the cover can then be screwed on the container neck of the cosmetics container equipped with the mating threaded portion. In that case, the pressure in the longitudinal direction required for the cover to seal the cosmetics container tightly so that no cosmetic can leak out is applied through the threaded portion at the end of the screwing-on process. As long as the user has screwed the cover sufficiently firmly onto the container neck, the friction between the threaded portion of the cover and of the container neck is sufficiently strong to ensure that the cover is not loosened inadvertently and no cosmetic leaks out subsequently. However, the user as a rule does not have any special option of checking whether the cover is screwed on tightly enough.

The known fine and, at the same time, long threaded portions in which the cover has to be screwed on to the cosmetics container firmly enough with several turns give rise to problems particularly in those cases where the important factor is that the applicator is always "parked" at the same position in the cosmetics container, if possible, or that the applicator connected to the cover is not rotated too far relative to the cosmetics container when the cosmetics container is closed.

In view of this, it is the object of the invention to provide an applicator closure or cosmetics package closure that can be fixed easily on the cosmetics container with a short rotary movement and which is nevertheless securely retained thereon.

SUMMARY OF THE INVENTION

Accordingly, a quick-fastening applicator closure with an applicator-side closure member and a container-side closure member is provided. The two closure members can be twisted relative to one another for fixing the applicator on the storage container associated with it. In this case, a multi-start, preferably double-start, or in some cases even a triple-start short threaded portion is provided on at least one of the closure members. This is designed in such a way that the two closure members can be brought from a position in which the threads of the short threaded portion grip for the first time into a fully closed position with a rotary movement of less than or equal to a ⅜ rotation, and preferably with less than a ¼ rotation relative to one another.

In this way, the user is spared the effort of a long process of screwing the unit open and shut, and instead is able to open or close the cosmetics unit in a convenient manner with a very short rotary movement, particularly also with one hand using only two fingers in order to generate a rotary movement on the top part.

Moreover, additional retaining elements are provided which hold the two closure members firmly against each other, once they have reached their fully closed position, in addition to the thread friction that is present anyway in a threaded portion of the type for which protection is sought. Said retaining elements are thus designed in such a way that they generate additional forces that prevent the two closure members from being subjected to an inadvertent relative movement from their closed position. In this manner, the quick-fastening closure is securely retained in its closed position. This is very important particularly in the case of cosmetics units because they are frequently transported in handbags or backpacks, where they are exposed to various shocks that must not lead to an opening or leaking of the cosmetics unit under any circumstances.

Preferably, the threaded portion is configured as a steep-pitch threaded portion at the same time. A steep-pitch threaded portion is understood to be a threaded portion in which the lead angle of each of the threads is at least 5° relative to the horizontal, better even at least 7°, and ideally even at least 8° to the horizontal. It should be noted, however, that threaded portions with a lead angle of 3.75° or more are already considered steep-pitch threaded portions in the field of cosmetics, which is the relevant one in this case. Such threaded portions are not preferred for carrying out this invention but nevertheless may be used herein.

The use of a steep-pitch threaded portion is of decisive advantage particularly if importance is attached to the centering device and/or sealing surface provided between the two closure members, or between a closure member and the bottle, or between the applicator and the bottle, coming into engagement with the mating surface associated with it not until the threads have begun to grip and, if possible, have already enforced an at least almost correct positioning of the parts relative to one another. In other cases, the use of a steep-pitch threaded portion is of a decisive advantage particularly if importance is attached to certain parts of the cosmetics unit actually coming into contact not until only a very short further rotary movement has yet to be carried out.

Finally, the use of a quickly closing steep-pitch threaded portion is especially advantageous where a so-called pincer applicator is to be fixed on the cosmetics container.

Said additional retaining elements are preferably formed by at least one latching projection and at least one latching depression that come into engagement in a positive fit as soon as the closure members reach or have reached their closed position. Ideally, the latching projection and the latching depression are configured in such a way that the user senses their snapping into or out of engagement by touch and/or acoustically when the closure members are twisted relative to one another.

Such additional retaining elements that act by positive fit fulfill their function particularly reliably because the forces developed by them are subject to significantly smaller fluctuations (for example due to wear) than, for example, the forces of additional retaining elements that act by frictional fit.

In addition, the clearly perceivable latching and unlatching offers certain control at any time on whether the cosmetics unit really was closed properly, or whether a short rotary movement—which may have only been the result of playing with the cosmetics unit—has sufficed for opening the cosmetics unit ultimately inadvertently.

An alternative embodiment that is to be used with preference in some cases provides that the additional retaining elements are formed by friction-enhancing elements. For example, the additional retaining elements can be formed by at least one thread narrowing towards its end in a wedge-shape. Thus, the mating threaded portion cooperating with this thread is able to wedge into the area of the thread under increased friction as soon as the closure members have reached their fully closed position. Such a configuration may make sense particularly if relatively brittle plastics are used, or if metal materials are used, which are sometimes employed for producing cosmetics containers in order to achieve a particularly high-quality appearance.

A preferred embodiment provides that each thread of the steep-pitch threaded portion is preceded by a so-called "free screw surface". Such a free screw surface leads the respective mating threaded portion to the corresponding thread of the steep-pitch threaded portion when the closure members are brought to rest against each other by a movement along their longitudinal axis and are then rotated relative to each other in the closing direction. The term "precede" in this case relates to the distance that is traveled along a helical surface of the threaded portion in the closing direction. A free screw surface is understood to be that helically extending surface that, seen in the direction of the longitudinal axis, forms a free end surface of the respective closure member marking the local end face of the closure member in the direction of the longitudinal axis, and against which the other closure member can come to rest by only displacing the closure members in the direction of the longitudinal axis towards each other. Such a free screw surface makes it considerably easier to introduce the mating threaded portions attached to the one closure member into the threads of the other closure member.

Preferably, the free screw surfaces respectively extend substantially over half the circumference of the respective closure member. At least, however, they cover an angle of rotation of about 90°.

Within the context of another preferred embodiment, it is provided that the free screw surface which, seen in the closing direction, is associated with a subsequent thread, extends into an area that overlaps a preceding thread, i.e. which, viewed in the direction of the longitudinal axis, lies above the preceding thread.

Separate protection is also sought for another preferred embodiment, independently from the statements above, alternatively, however, also using the statements above. This preferred embodiment is a quick-fastening applicator closure characterized in that, on one of its closure members, a threaded portion with at least one thread is provided whose boundary on one thread side is formed by a tongue that is unilaterally attached only in the area of the circumferential end of the thread. Due to this "unilateral attachment", the tongue protrudes from the rest of the respective closure member like a cantilever beam which projects predominantly or substantially in the direction of the thread lead. This means that the tongue has a free tongue tip and four free side surfaces, i.e. a radially outward-facing one, a radially inward-facing one as well as a top surface extending approximately perpendicularly to the longitudinal axis, and a bottom surface extending approximately perpendicularly to the longitudinal axis. In most cases, this preferred embodiment is configured in such a way that the thread in this case only forms a kind of hook into which a mating counterpart can be hooked.

The advantage of such a tongue is its elasticity. Such a tongue is able to resiliently give way by the required amount during the closing process and thus "run over" a latching element intended to latch into a latching depression which, seen in the closing direction, lies behind the tongue tip or even the entire tongue.

Preferably, the tongue and the latching element are configured in such a way that the tongue, when "running over" the latching element, yields elastically outwards in the radial direction, thus giving way to the latching element at least partially, so that it can run over that with comparative ease. It is ideal if the tongue gives way even predominantly or exclusively in the radial direction.

Alternatively, the tongue and the latching element are configured in such a way that the tongue, when "running over" the latching element, yields elastically approximately in the direction of the longitudinal axis or axis of rotation of the applicator or cosmetics unit, thus giving way to the latching element at least partially, so that it can run over that with comparative ease.

Preferably, the tip of the tongue comprises an oblique leading surface that makes it easier for the tongue to run over a latching projection during closing, which is supposed to come to lie in a latching depression that, viewed in the closing direction, is located behind the tongue tip.

The quick-fastening closure according to the invention can be useful also in the case in which a cosmetics container is only to be closed with a cover without an applicator taking part. For example, the quick-fastening closure according to the invention can also be used very well for closing perfume bottles. Due to this fact, protection is also sought for this broader field of application and product area, although only second to the main field of application of the quick-fastening applicator closure. The person skilled in the art understands that certain terms have to be read adapted with regard to their meaning in this last protected variant, e.g. by reading "cover-side closure member", respectively, for "applicator-side closure member" in the following.

Further effects, advantages and optional embodiments of the invention described in this document become apparent from the following description with which the exemplary embodiments are explained in more detail with reference to the figures.

BRIEF DESCRIPTION OF THE DRAWINGS

In the Figures:

FIG. 8 shows the closure member shown by FIG. 7 in another position of use.

DETAILED DESCRIPTION OF THE PREFERRED EMBODIMENTS

Figures 1, 2:
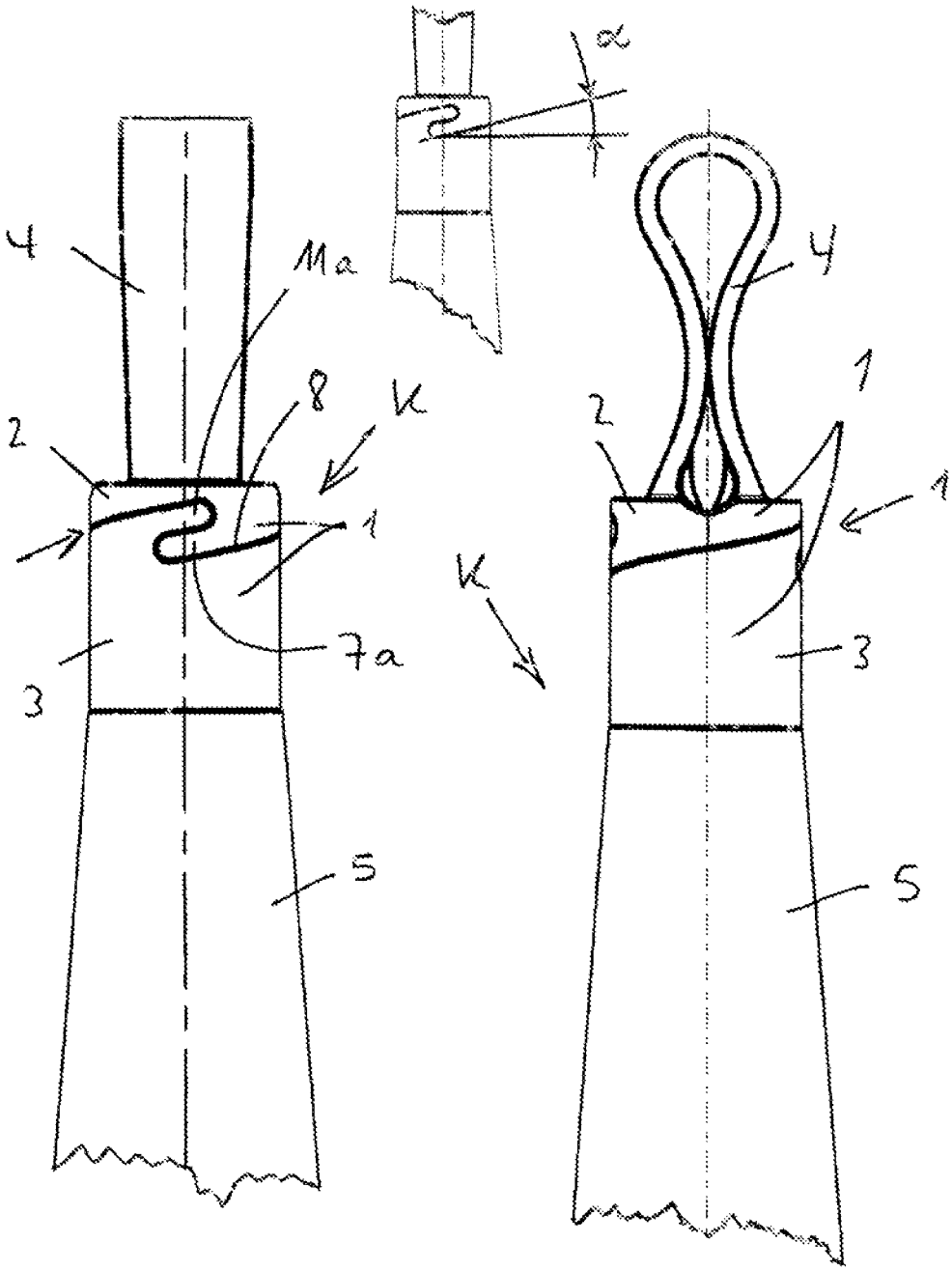
FIG. 1 shows a first exemplary embodiment of a cosmetics container with the quick-fastening applicator closure according to the invention in a front view.
FIG. 2 shows a first exemplary embodiment of a cosmetics container with the quick-fastening applicator closure according to the invention in a side view.

FIG. 1 shows a first overview of the cosmetics unit K according to the invention with the quick-fastening closure 1 according to the invention. As can be seen, the quick-fastening closure 1 consists of an applicator-side closure member 2 and a container-side closure member 3. The applicator-side closure member transitions into a cover or a retaining section in a multi-part or integral design.

As a rule, the container-side closure member is a multi-part or integral component of a collar 6 placed on the storage container 5. In the case shown here in the drawing, the container-side closure member is an integral component of the collar 6 and is therefore to be equated with it. In the present case, the collar 6 is screwed on to the neck of the storage container 5 with a threaded portion 16 of the customary type; however, it may also be latched on to it. If such a threaded portion 16 is used, latching devices are as a rule provided in the vicinity of the threaded portion or in the threaded portion itself, with which the collar 6 latches into corresponding latching devices of the container. An inadvertent detachment of the collar 6 is thus avoided. Such an additional collar 6 offers the advantage that, with regard to the storage container, it does not have to be taken into consideration whether the quick-fastening closure is supposed to be used or not. Thus, inexpensive standard containers can be used. Alternatively, the container-side closure member can, however, also be an integral component directly of the storage container 5, and in that case is, as a rule, injection-molded on a storage container 5, which is not shown here.

Figure 3:
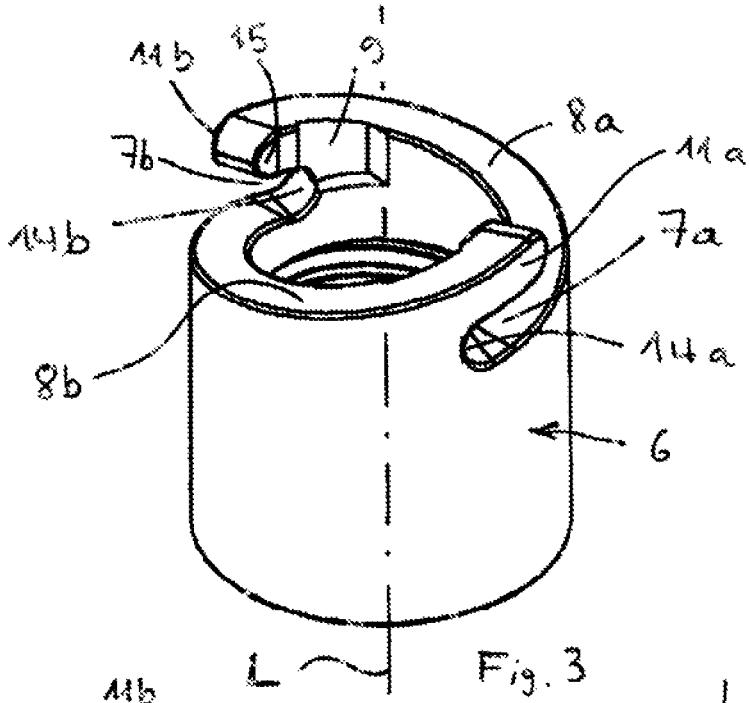
FIG. 3 shows one of the closure members which can be realized in this form on the side of the applicator or on the side of the storage container.
Figure 3A:
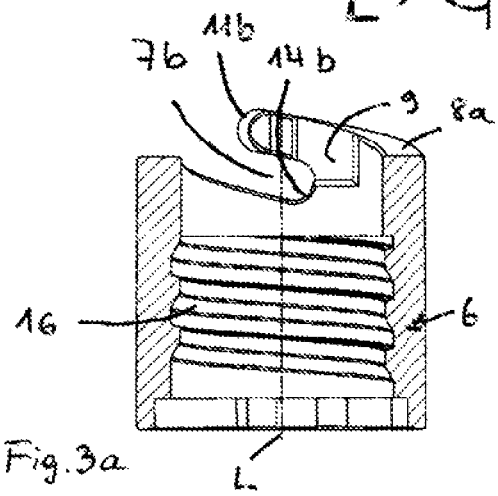
FIG. 3*a* shows a sectional view of the closure member according to FIG. 3.
Figure 3B:
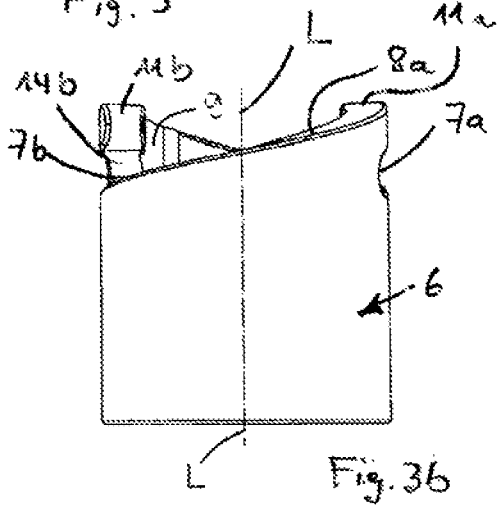
FIG. 3*b* shows a side view of the closure member according to FIG. 3.
Figure 3C:
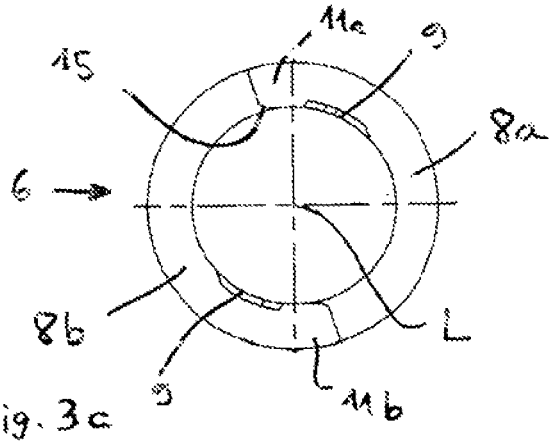
FIG. 3*c* shows a view of the closure member according to FIG. 3 from above.
Figure 3D:
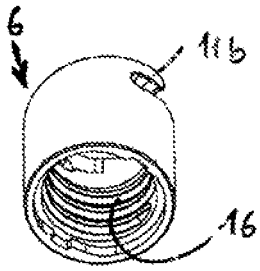
FIG. 3*d* shows a perspective view of the closure member according to FIG. 3 from below.

The exact functional principle of the invention can best be described with reference to the FIG. 3. In this specific exemplary embodiment, FIG. 3 shows the container-side closure member 3. However, it should be remarked for the sake of completeness that the closure member thus configured does not necessarily have to be the container-side closure member 3, but could in principle also be the applicator-side closure member.

The crucial point is that at least one of the two closure members, as provided by the invention, has to be provided with a multi-start steep-pitch threaded portion designed in such a way that the two closure members can be brought from a position in which the threads of the steep-pitch threaded portion grip for the first time into a fully closed position with less than a ⅜ turn relative to one another. Preferably, the design is such that the closing process just described can take place with less than a ¼ turn or ideally even with less than ⅛ turn.

The multi-start threaded portion, which in the present case is a double-start threaded portion formed of the threaded portions 7*a* and 7*b*, is clearly recognizable in FIG. 3. The term thread denotes the area which is closed on three sides, towards the top, towards the bottom and in one circumferential direction, and with which the closure member can therefore exert a force on the other closure member that acts in a closing manner. It can also be recognized clearly that each thread is preceded by a free screw surface 8*a* or 8*b* (the term "precedes" relates to the closing direction).

The threaded portion is configured as a steep-pitch threaded portion, i.e. the lead angle $\alpha$ of each of the threads is at least 5° relative to the horizontal, better even at least 7° to the horizontal (see detailed view for FIGS. 1 and 2). Ideally, at least 8° to the horizontal is selected. In this exemplary embodiment, the lead angle $\alpha$ is about 9° to the horizontal.

Figure 4:
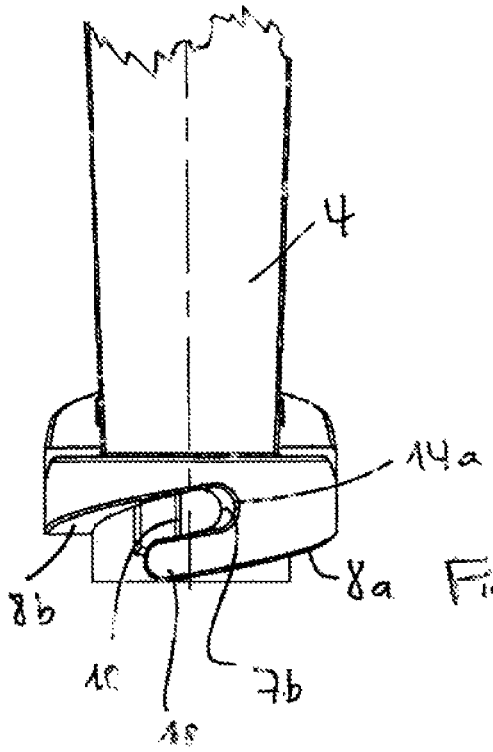
FIG. 4 shows a side view of an exemplary embodiment for a complementary closure member for cooperation with the closure member shown by FIG. 3.
Figure 5:
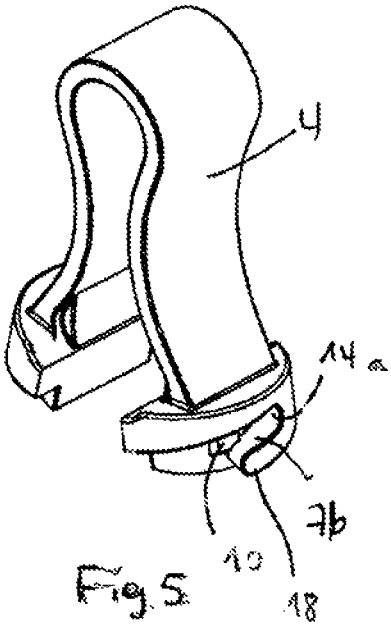
FIG. 5 shows a different exemplary embodiment for a closure member of the type shown by FIG. 4.
Figure 6:
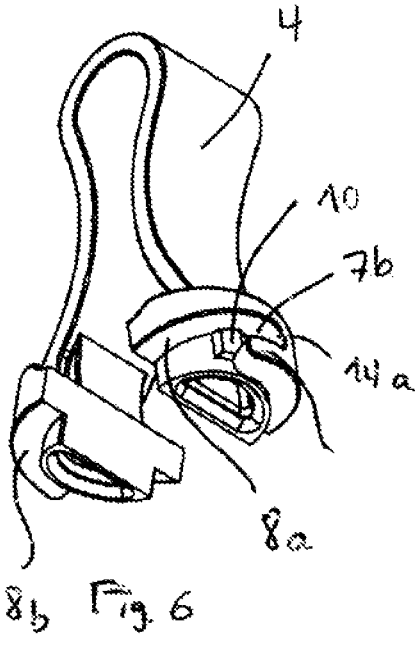
FIG. 6 shows the exemplary embodiment described by FIG. 5 from another perspective.
Figure 6:
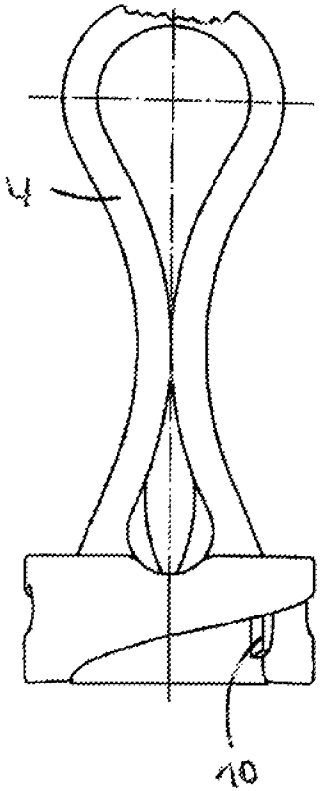
Figure 7:
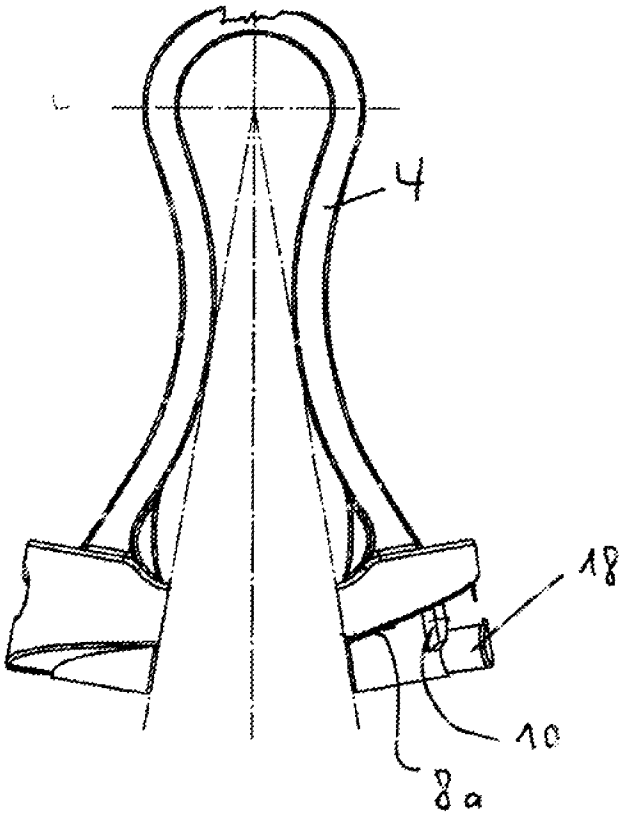
FIG. 7 shows the closure member described by FIG. 5 from another perspective.

As can also be seen clearly in FIG. 3, latching recesses 9, into which corresponding latching projections 10 (see FIG. 4) of the other closure member are inserted once the closure members have reached their fully closed position relative to one another, are preferably provided directly in the area (of at least one thread) of the threads. These latching recesses 9 and the associated latching projections 10 additionally form retaining elements that retain the two closure members in addition to the thread friction that is present anyway, in this case by positive fit.

The special feature of the threaded portion shown by FIG. 3 is that the threaded portion is incorporated into a hollow-cylindrical section of the closure member in such a way that the free screw surfaces form the narrow limiting surfaces at the end-faces of the hollow-cylindrical section and the two threads 7*a* and 7*b* completely penetrate the wall of the hollow-cylindrical section in the radial direction, i.e. respectively form a "window" in the wall of the hollow-cylindrical section, so to speak. This results in, respectively, a first tongue 11*a* and a second tongue 11*b* which respectively form a side wall of the respective threaded portion 7*a* or 7*b* and which respectively are only attached unilaterally in the area of the end of the thread. In particular when the closure member is produced from a plastic and the tongues 11*a* and 11*b* are dimensioned so as not to be too thick, they behave like leaf spring elements as a result, i.e. the tongues 11*a* and 11*b* can be bent outwards in the radial direction to a small extent without too much force being applied. Preferably, this effect is used to make it considerably easier for the latching recesses 9 incorporated into the tongues to latch into the complementary latching projections 10—once the tongues 11*a* and 11*b* come into contact on their tips with the latching projections 10 during the screwing-on process, they yield in a radially outward direction and preferably spring back radially into their original position only when the latching projections 10 have been inserted into the latching recesses 9.

As can best be seen in FIG. 3, the free screw surfaces 8*a* and 8*b* respectively extend substantially over half the circumference of the closure member.

Figure 10:
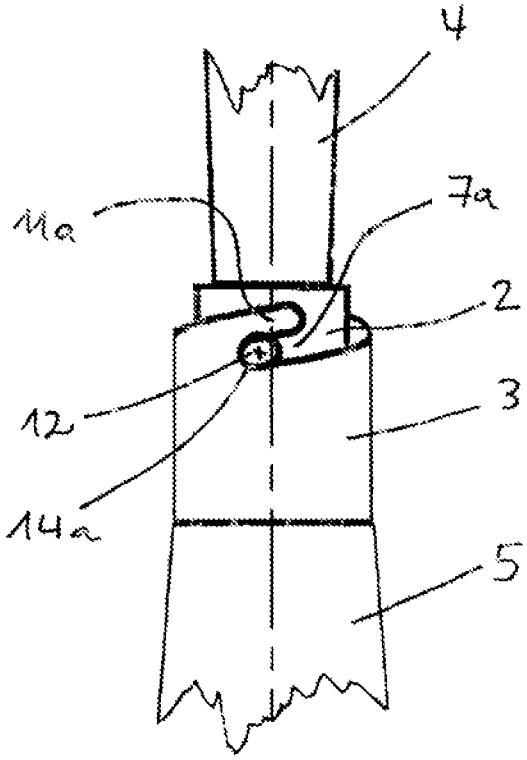
FIG. 10 shows an alternative embodiment to the quick-fastening applicator closure shown by FIG. 1.

Instead of the way described above, or also additionally, the tongues can also be designed in such a way that they yield in a spring-elastic manner in the direction of the longitudinal axis L or perpendicularly to the free screw surface 8*a* or 8*b*, so that the effect just described for the yielding in the radial direction can be exploited analogously. FIG. 10 illustrates such an alternative embodiment. However, it is important that attention is paid in such an embodiment that the tongues are actually able to exert a certain play in the direction of the longitudinal axis or perpendicularly to the free screw surface. If necessary, local cut-outs have to be provided for this purpose in that case.

Figure 11:
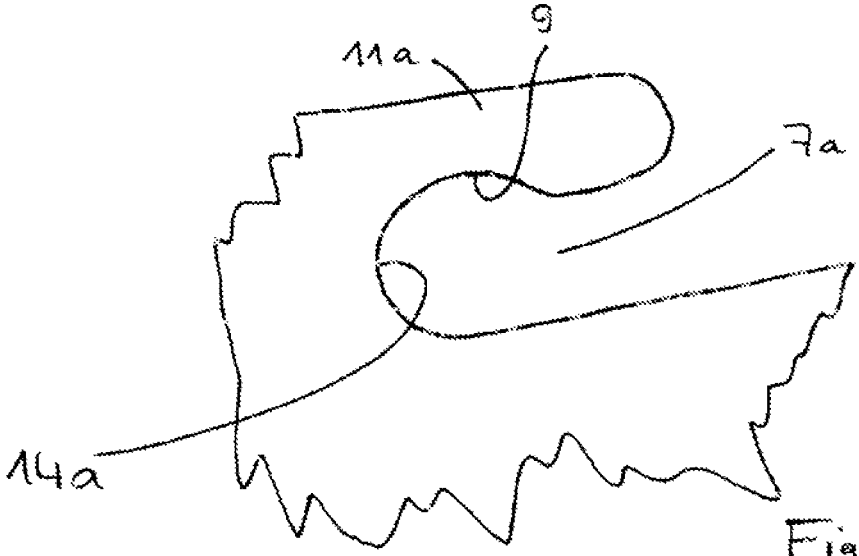
FIG. 11 shows an enlarged section from the area of the thread according to FIG. 10.

In the alternative embodiment shown by FIG. 10, the tongues are readily able to exert a certain play in the direction of the longitudinal axis or perpendicularly to the free screw surface. This is due to the fact that, in this alternative embodiment, only one of the two closure members is provided with the multi-start steep-pitch threaded portion according to the invention, whereas the other closure member has a smoothcylindrical outer contour, from whose circumferential surface local appendages protrude at the appropriate places. These appendages move into the threads 7*a* and 7*b* of the steep-pitch threaded portion when the two closure members are rotated relative to one another into the closing position. In the modification according to FIG. 10, these local appendages are configured as circular stubs 12. As FIG. 11, which depicts an enlarged section, shows, these stubs latch into the latching recess 9 if required.

As can best be seen in the FIGS. 1 and 2, the two closure members 2 and 3, however, can each also be configured complementary to a double-start steep-pitch threaded portion consisting of one first thread each and one second thread each as well as one first free screw surface each and one second free screw surface each. As a rule, however, only one closure member will have tongues that are resilient whereas the tongues of the other closure member are rigid. This is due to the fact that the steep-pitch threaded portion is incorporated into a sleeve section only in one closure member, whereas it is generally incorporated into a massive cylinder section in the other closure member, so that the tongues are attached at their radially inward-facing side also in this case, which makes them very rigid of course.

Figure 9:
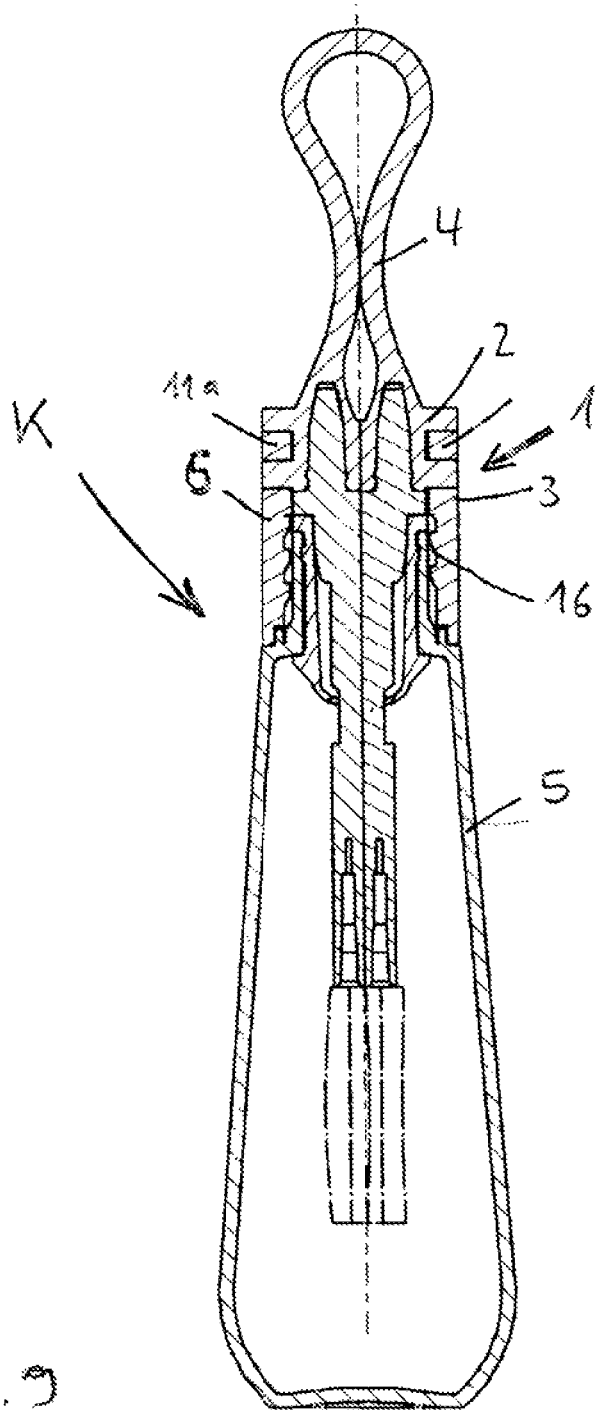
FIG. 9 shows an exemplary embodiment in the form of a complete cosmetics unit that demonstrates in an exemplary manner how the closure member according to the invention can be usefully employed.

Such a closure member, in this case in the form of an applicator-side closure member 2 as it ideally cooperates with the closure member shown by FIG. 3, is shown by the FIGS. 4 to 8. It should be noted in this case that the special handle part 4 and the bipartite design of the closure member that can be seen in these figures are not the important point. In this regard, the illustrations in the closure member are merely exemplary because the closure members of the special case shown by FIG. 9 is that of a pair of so-called mascara pincers.

The decisive fact is that the latching projection 10 can be seen here, which is to be brought into engagement with the latching projection 9 shown by FIG. 3, and which can be run over by the tongues 11*a* or 11*b* for this purpose.

It can be seen very well in these FIGS. 4 to 8 that this complementary closure member also preferably comprises a first thread and a second thread. For the sake of simplicity, both threads are also marked with the reference numerals 7*a* and 7*b* even though they are not the same threads as those shown by FIG. 3, but the corresponding threads of the complementary part provided for engagement with the closure member shown by FIG. 3. The same applies, mutatis mutandis, to the reference numerals 8*a* and 8*b* as well as to the reference numerals 14.

It should be noted that the solid sections marked with the reference numeral 18 are substantially rigid both in the radial direction as well as in the direction of the longitudinal axis; in this, they differ from the tongues 11*a* and 11*b* from FIG. 3, even if they look rather similar to them in other respects.

As can be readily seen in the Figures, the steep-pitch threaded portion in the present case is designed in such a way in the exemplary embodiments that it extends into the visible outer surface of the cosmetics unit in the finished cosmetics unit. Such a design not only has a certain aesthetic appeal, but also considerably simplifies operation—due to the fact that the user always sees the threaded portion, she will as a rule automatically place the two closure members onto one another during the closing process in such a way that she can bring the closure members into their closed position with an efficient rotary movement that is as short as possible.

Moreover, the steep-pitch threaded portion in the exemplary embodiment shown by FIGS. 1 to 9 is configured in such a way that the two closure members form a uniform body with a continuously smooth visible outer surface, even though the steep-pitch threaded portions extend into the visible outer surface. Such a design is not only very appealing aesthetically, but also makes sense from a hygienic standpoint—if some of the cosmetic mass should have deposited in the area of the threaded portion, it is relatively easy to wipe off in the case of such a design.

Moreover, it should be noted that the threads 7*a* and 7*b* in the exemplary embodiments shown here have a pronounced thread end which serves as a defined stop (14*a* or 14*b*), which is indeed reached during the closing process. This leads to the cosmetics applicator always coming to lie in the same final position—which is not the case in the known cosmetics applicators which were screwed on using a fine threaded portion that permits a more or less strong screw-on action, so that the cosmetics applicator comes to lie into different positions, depending on how strongly it was screwed shut.

Figure 12:
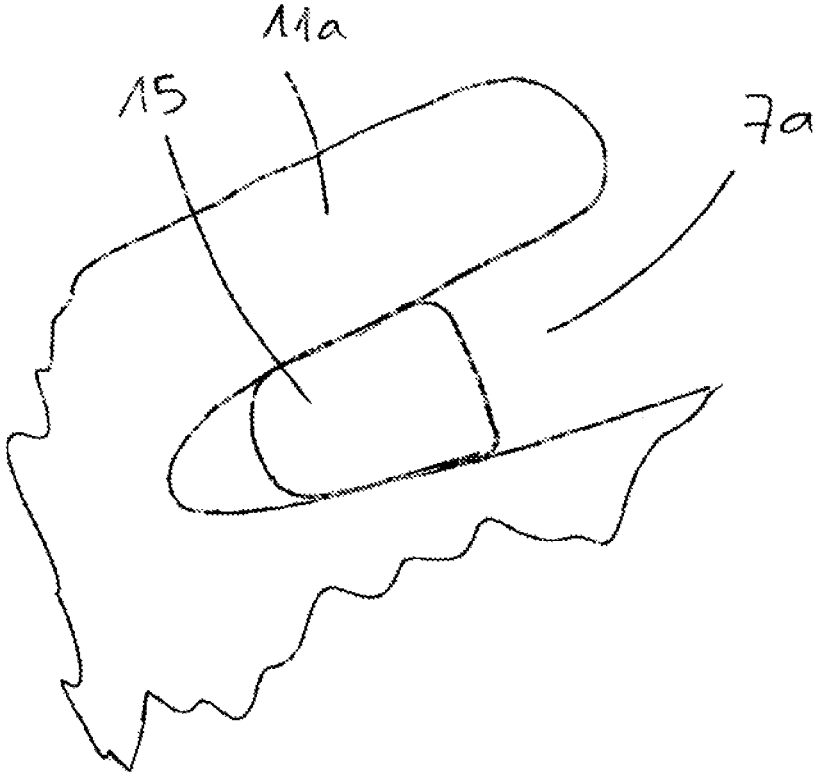
FIG. 12 shows an alternative exemplary embodiment of the thread.

As can easily be seen in FIG. 12, a retaining element can be used that increases friction and thus ensures that the two closure members are held firmly against each other in addition to the thread friction that is present anyway, once they have reached their fully closed position, instead of a retaining element consisting of positive-fit elements. For this purpose, the threads 7*a* and 7*b* are designed in such a way that they narrow towards their end in a wedge-shape so that the correspondingly configured mating threaded portion 15 wedges into the narrowed portion under increased friction when the closure members have reached their fully closed position.

The other Figures of the set of FIGS. 1 to 14 that were not discussed in detail so far show the quick-fastening closure according to the invention or parts thereof from different viewing angles, and therefore also contribute to understanding the invention.

The invention claimed is:

1. A quick-fastening cosmetic applicator closure comprising:

a cap-side closure member and a container-side closure member which are twisted relative to one another in order to fix an applicator on a storage container associated with the applicator;

a multi-start, short threaded portion provided on at least one of the closure members, whose threads are designed in such a way that the threads protrude like a cantilever beam, and the two closure members can be brought from a position in which the threads of the short threaded portion grip for the first time into a fully closed position with a rotary movement of less than or equal to a ⅜ rotation relative to one another; and additional retaining elements that hold the two closure members firmly against each other in addition to thread friction that is present anyway, once the two closure members have reached their fully closed position, wherein the additional retaining elements are formed by at least one latching projection and at least one latching depression that come into engagement in a positive fit as soon as the closure members have reached their fully closed position.

2. The quick-fastening applicator closure according to claim 1, wherein the short threaded portion is a steep-pitch threaded portion with a lead angle of greater than 5°.

3. The quick-fastening applicator closure according to claim 1, wherein each thread is preceded by a free screw surface that leads a respective mating threaded portion to a corresponding thread of the threaded portion when the closure members are brought to rest against each other by a movement along their longitudinal axis and are then rotated relative to each other in a closing direction.

4. The quick-fastening applicator closure according to claim 3, wherein the free screw surfaces respectively extend substantially over half a circumference of a respective closure member.

5. The quick-fastening applicator closure according to claim 3, wherein the free screw surface which, as viewed from the closing direction, is associated with a subsequent thread, extends into an area that overlaps a preceding thread.

6. The quick-fastening applicator closure according to claim 1, wherein the threaded portion comprises at an end of its at least one thread a positive-fit stop that prevents the two closure members from being twisted relative to one another even further in the closing direction.

7. A quick-fastening applicator closure comprising:

an applicator-side closure member and a container-side closure member which are twisted relative to one another in order to fix a mascara applicator on a storage container associated with the mascara applicator, wherein, on one of the closure members, a threaded portion with at least one thread is provided whose boundary on one thread side is formed by a tongue that is unilaterally attached only in an area of a circumferential end of the thread and which protrudes like a cantilever beam in a direction of the thread lead, and the tongue, while running over a latching element, yields elastically outwards in a radial direction.

8. The quick-fastening applicator closure according to claim 7, wherein the unilaterally attached tongue is able to interact with a latching element associated with the tongue in order to hold the closure members firmly against each other in addition to thread friction that is present anyway, once the closure members have reached their fully closed position.

9. The quick-fastening applicator closure according to claim 7, wherein the tongue, while running over a latching element, yields in a direction of a longitudinal axis.

10. The quick-fastening applicator closure according to claim 7, wherein a tip of the tongue comprises an oblique leading surface that makes it easier for the tongue to run over a latching projection during closing, which is supposed to come to lie in a latching depression that, viewed in a closing direction, is located behind the tongue tip.

11. A mascara unit comprising a storage bottle, a cosmetics supply, a cover and an applicator for applying the cosmetic, wherein the mascara unit comprises a quick-fastening applicator closure according to claim 1.

12. A mascara unit comprising a storage bottle, a cosmetics supply, a cover and an applicator for applying the cosmetic, wherein the mascara unit comprises a quick-fastening applicator closure according to claim 7.

* * * * *